US005094437A

United States Patent [19]

Hauschild

[11] Patent Number: 5,094,437

[45] Date of Patent: Mar. 10, 1992

[54] APPARATUS FOR THE FORMATION OF STACKS OF TISSUES OR THE LIKE OF FIBROUS MATERIALS

[75] Inventor: Gilbert Hauschild, Neuwied, Fed. Rep. of Germany

[73] Assignee: Winkler & Dunnebier Maschinenfabrik und Eisengiesserei KG, Fed. Rep. of Germany

[21] Appl. No.: 543,389

[22] Filed: Jun. 26, 1990

[30] Foreign Application Priority Data

Aug. 2, 1989 [DE] Fed. Rep. of Germany ..... 3925623

[51] Int. Cl.[5] ..... B41L 1/32

[52] U.S. Cl. ..... 270/39

[58] Field of Search ..... 270/30, 31, 39; 493/355-357, 359, 360, 410, 425, 430, 433

[56] References Cited

U.S. PATENT DOCUMENTS

| | | | |
|---|---|---|---|
| 2,761,677 | 9/1956 | Rutkus | 270/39 |
| 4,070,014 | 1/1978 | Takahashi | 270/39 |
| 4,494,741 | 1/1985 | Fischer | 270/39 |
| 4,718,654 | 1/1988 | Ehlers | 270/39 |
| 4,721,295 | 1/1988 | Hathaway | 270/39 |
| 4,770,402 | 9/1988 | Couturier | 270/39 |

FOREIGN PATENT DOCUMENTS

| | | | |
|---|---|---|---|
| 89163 | 7/1980 | Japan | 270/39 |

*Primary Examiner*—Edward K. Look
*Assistant Examiner*—Therese M. Newholm
*Attorney, Agent, or Firm*—Nies, Kurz, Bergert & Tamburro

[57] ABSTRACT

An apparatus for the formation of stacks of folded, zigzaggedly intermeshed tissues, sheets or the like of any kind of fibrous materials, with a folding device having two folder rolls, wherein each of the two folder rolls (23) is associated with at least one comb-like depositor (27) on both sides of the stack shaft (13), said depositor consisting of a depositor beam (28) with a plurality of laterally guided depositing fingers (26) swung back and forth relative to the tissue stack (12) via connecting rods (30) by first drives (32, 33) and by second drives (35, 36, 37, 38, 39) such that the front ends of the laterally and vertically reciprocating depositing fingers (26) grasp behind the respective tissue (22) to be deposited, press down against the tissue stack (12) and hold the same securely in the shaft (13) until a new cycle of movement begins.

7 Claims, 2 Drawing Sheets

APPARATUS FOR THE FORMATION OF STACKS OF TISSUES OR THE LIKE OF FIBROUS MATERIALS

BACKGROUND OF THE INVENTION

The invention refers to an apparatus for the formation of stacks of folded, zigzaggedly intermeshed tissues, sheets or the like of fibrous materials. In the following, for simplicity's sake, reference will be made solely to tissues, which can consist of fibrous materials of any type such as cellulose, natural and/or synthetic staple fibers or mixtures of these fibers or the like, including all sheet-like cuttings. In particular, cellulose or such tissues for hygienic or cosmetic and similar purposes can be considered. With the apparatus the individual tissues are intermeshed such that part of one tissue is covered by part of the immediately following tissue.

Two fibrous material webs are fed to this apparatus, each one of which has an associated cutting device for transversely cutting the webs into individual tissues in staggered relation to one another. The cutting device is equipped with folding devices for folding the separated tissues along a transverse line, a shaft receiving the tissue stack, and associated with the shaft a device for depositing and holding down the respective uppermost tissue in the formation of the stack.

An apparatus of this type has already been made known in the U.S. Letters Pat. No. 2,761,676. in this apparatus, the device for depositing and holding down the respective uppermost tissue of the stack consists of comb-like depositors with depositing fingers for taking the individual tissues from the rollers delivering the same and pressing them onto the stack, and of comb-like holding down means with holding fingers for lying across the stack in the tissue stack shaft upon the deposition of each uppermost tissue to securely hold the stack, which is under a certain amount of tension in the shaft, and to prevent upward movements of the same after each tissue is deposited.

The aforementioned mechanism has a complex and intricate construction. Both the depositing fingers and the holding fingers of the holding down means, which reach between the depositing fingers, must work in tact with the machine. In particular, this means that they must become active in every work cycle, i.e. with each deposition of a tissue. To ensure an orderly deposition of the folded tissues and an accurate stack formation, the working speed of the apparatus is limited, particularly since significantly heavy masses must be relatively quickly moved, especially accelerated, and slowed down, resulting in undesirable vibrations if the apparatus is run too rapidly.

OBJECT OF THE INVENTION

The invention is based on the task of improving apparatuses of the type in question in order to thereby reduce the forces of gravity and thus accelerate the work steps and hence to increase productivity, without detracting from the quality and the precise formation of the tissue stack.

For the solution of this task, the proposal according to the invention is to provide a novel apparatus for the formation of stacks of folded, zig-zaggedly intermeshed tissues or sheets of any kind of fibrous materials with the tissues being individually intermeshed such that part of the tissue is covered by part of the immediately following tissue, with the apparatus having mechanisms for supplying two fibrous material webs, and having a cutting device associated with each of the two webs for transversely cutting the webs into individual tissues fed in staggered relation to one another; a folding roll is provided for each separate group of cut tissues for folding the separate, staggered tissues along a transverse line; a shaft for receiving the folded intermeshed tissue stack; and depositor mechanisms associated with the shaft for depositing and holding down the respective uppermost tissue fed to the stack. Each of the folding rolls is associated with at least one comb-like depositor of the depositor mechanism and each folding roll and depositor mechanism are disposed on opposite sides of the stack shaft. The depositor consists of a depositor beam with a plurality of laterally guided depositing fingers swung back and forth relative to the tissue stack through means of connecting rods driven by first drives and by second drives so that the front ends of the depositing fingers are laterally and vertically reciprocating to grasp behind the respective tissue to be deposited, then to press down against the tissue stack and hold the tissue securely in the shaft until a new cycle of movement begins.

Further novel aspects of the invention include, in an apparatus as discussed above, several, two or three, depositors being provided for each folder roll, with at least the front ends of the depositing fingers of each associated set of depositors being parallel to one another and lying on the same plane. The drive mechanisms of the associated several depositors are designed so that each single depositor of the associated set catches, presses down and holds fast only every second or third tissue to be deposited in the stack.

Further novel features and other objects of this invention are to be found in the subclaims and in the following description of a preferred embodiment of an apparatus for the formation of stacks of fibrous material tissues as schematically represented in FIGS. 1 to 4.

DETAILED DESCRIPTION OF THE DRAWINGS

Figure 1:
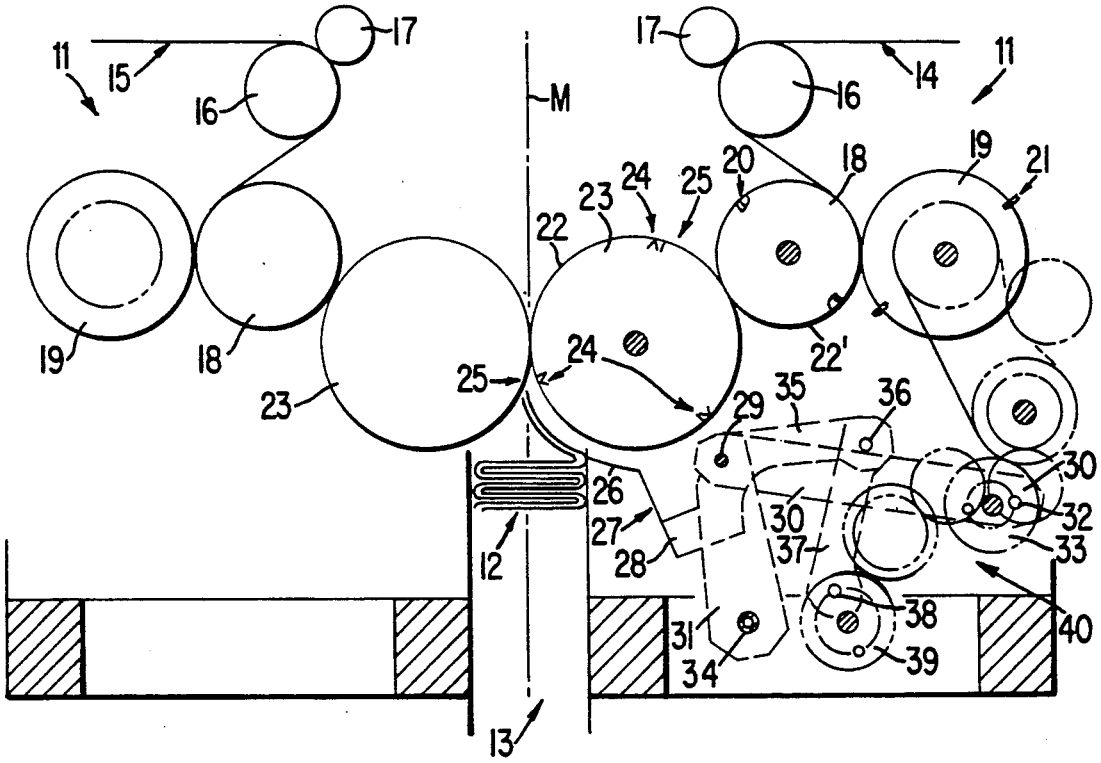
FIG. 1 shows a cross section through an apparatus equipped on each side of the tissue stack shaft with one depositor at each side, in which the contruction of the apparatus is recognizable.

As shown in FIG. 1, the apparatus is constructed in identical mirror-image fashion relative to the center plane M, so for simplicity's sake, in the following, merely the one side of the apparatus is described with regard to its construction.

The two apparatus 11 for the formation of a tissue stack 12 in a shaft 13 receiving the same disposed in the center plane M, each have devices for supplying the material webs 14 and 15, which are guided by drawing rolls 16, 17 between the two knife rolls 18 and 19. The knives 20 and 21 of the knife rolls 18, 19 cut the webs 14 and 15 transversely into individual sections or tissues 22, each of equal length, which are then passed on to the folder rolls 23. These folder rolls 23 are provided with mouthpieces 24 arranged along a convex surface line, for suctioning or releasing the respective front edges 25 of the individual tissues 22. A vacuum source can be connected to said mouthpieces. The folder rolls 23 are provided across their periphery with a plurality of parallel grooves not shown, with which the front ends of the depositing fingers 26 of the comb-like depositors 27 can mesh, to grasp behind the front edge 25 of the tissues 22 being supplied and to be able to press them downwardly onto the tissue stack 12 with the downward motion of said fingers.

The depositors 27 consist of a beam 28 beneath the folder roll 23 and extending parallel to it, with the depositing fingers 26 fastened to said beam at equal distances apart. Journal pins 29 are located on both ends of the depositor beam 28, with connecting rods 30 on the one hand and rocking arms 31 on the other engaging said journal pins. The rear ends of the connecting rods 30 are mounted on the crank pins 32 of the crank discs 33. The lower ends of the rocking arms 31 perform rocking movements around the stationary journal pins 34. In addition, lever arms 35 are fastened to the depositor beam 28, the rear ends of which lever arms are coupled to the driving rods 37 by journal pins 36, the lower ends of said driving rods being seated on the crank pins 38 of the crank discs 39. The crank discs 33, 39 or their shafts are driven synchronously to each other via a toothed gearing 40, namely as a function of the rotation of the knife rolls 18, 19 and/or the folder rolls 23.

The crank drives 32, 33 acting on the connecting rods 30 provide for a back-and-forth reciprocating movement of the depositor beam 28. Via the lever arms 35, the crank drives 38, 39 effect a pivoting of the depositor beam 28 and hence of the depositing fingers 26 during their back-and-forth movement.

Figure 2:
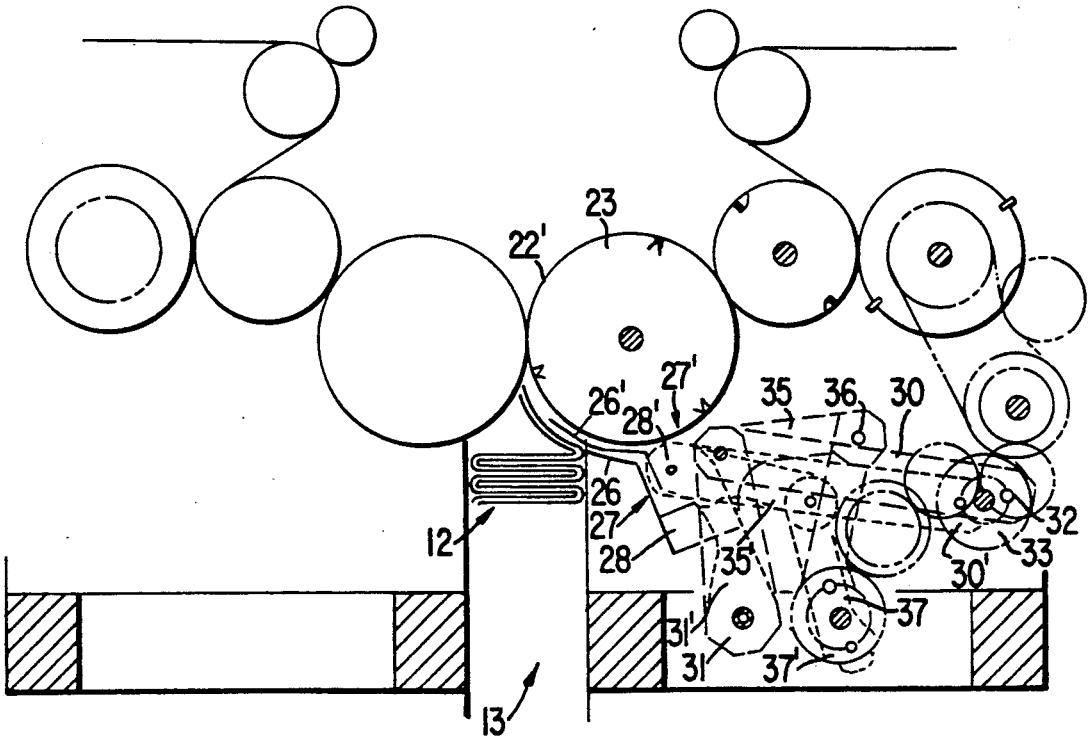
FIG. 2 shows a cross section through an apparatus, with the depositing mechanism having two depositors arranged at each side of the stack.

In the embodiment according to FIG. 2, the depositing device for the tissues 22 has two depositors 27 and 27', one device being loaded on each side of the tissue stack shaft 13, the beams 28 and 28' of which depositors are arranged in superposed but spaced relationship to one another, in order to have the necessary freedom of movement. The depositing fingers 26 on the depositor beam 28 are spaced apart sufficiently so that the depositing fingers 26' on the depositor beam 28' can reach between them, to successively remove one tissue 22 or 22' at a time from the folder roll 23 and to deposit it on the tissue stack 12. The drive mechanisms for the depositors 27 and 27' correspond to those of the embodiments according to FIG. 1. The connecting rods 30' and the driving rods 37', however, are linked to the crank discs 33 and 39 so as to be offset by 180° relative to the connecting rods 30 or the driving rods 37. The crank discs rotate in this case only at half rotational speed, as the fingers 26 and/or 26', respectively, need only to grasp and deposit every second tissue 22 or 22' leaving the folder roll 23. In this way the working speed of the depositors 27, 27' can be reduced by half with the same performance rate, which offers substantial advantages.

And, for example if three depositors 27 are provided, then their working speed is reduced to one-third.

Figure 3:
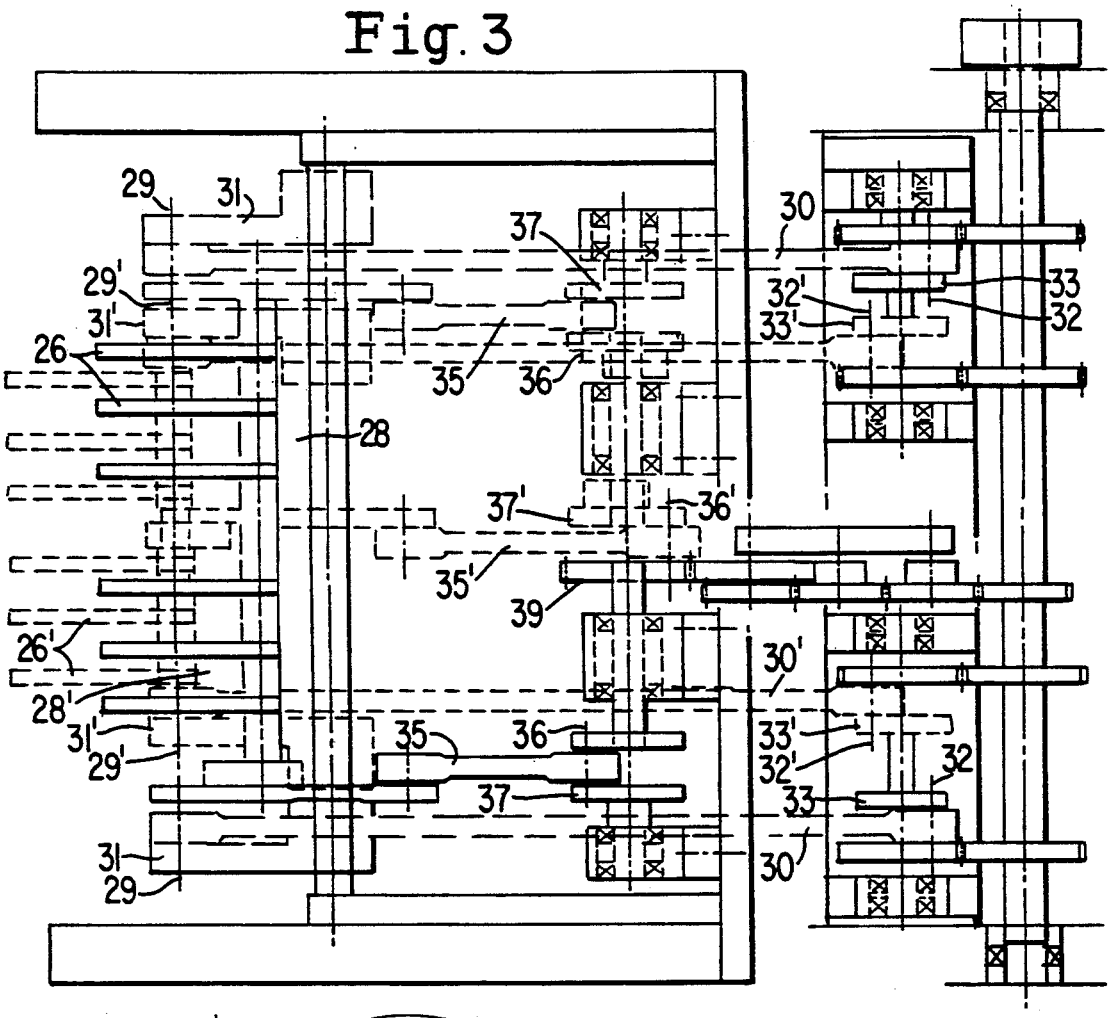
FIG. 3 shows a plan view of the apparatus according to FIG. 2.

The course of movement of the moved parts of the depositing device according to FIG. 2 is particularly clear in the schematic drawing of FIG. 3. The interrupted lines refer to the individual elements of the depositor 27, while the dotted lines depict the individual elements of the depositor 27'.

Figure 4:
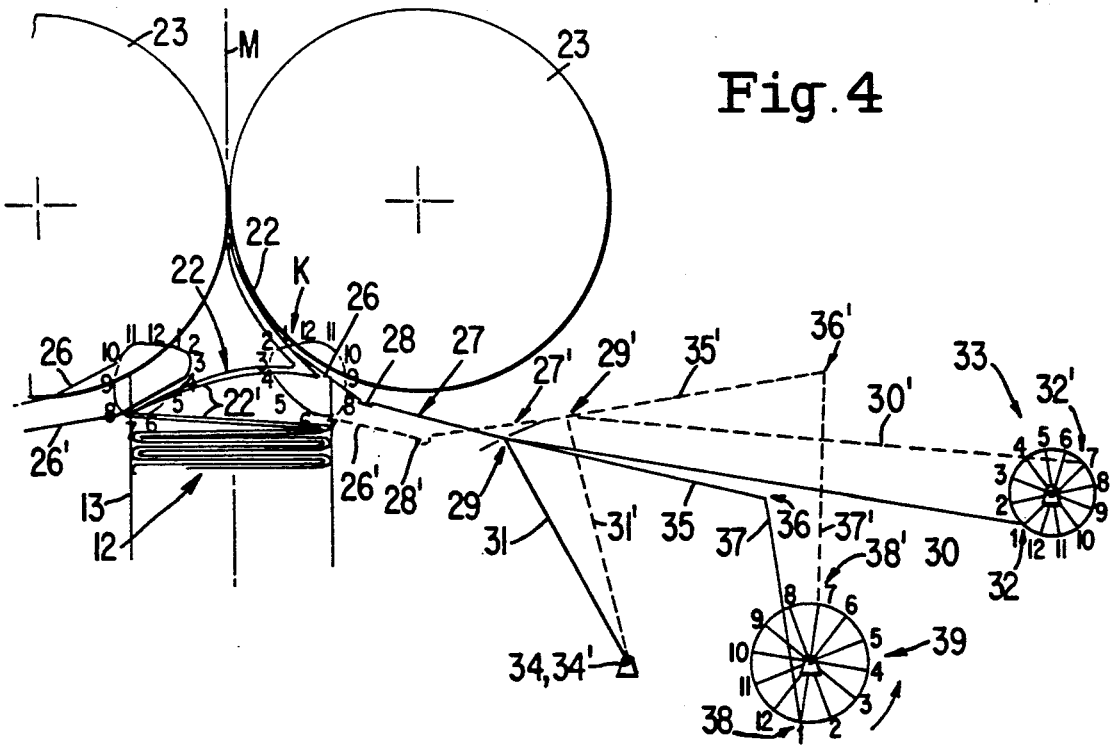
FIG. 4 shows the principle of the depositing and holding down mechanism of the apparatus shown in FIGS. 2 and 3, designed in accordance with the invention.

In the position shown in FIG. 4, the front ends of the depositing fingers 26 are located in position 1 of the curve K described by said fingers during one cycle of movement. The crank pins 32 and/or 38 of the two crank mechanisms then likewise assume position 1 on the crank circles on which they move. As shown in FIG. 4, the depositor 27 is almost fully advanced toward the tissue stack shaft 13, with the fingers 26 grasping behind the tissue 22. Contrary to this, the depositor 27' is almost completely withdrawn, with the front ends of the fingers 26' still lying on the tissue stack 12 or on the uppermost tissue 22' thereof, to hold the same down until they are relieved by the fingers 26 of the depositor 27 upon their downward movement along the curve K.

Instead of the crank mechanisms given and shown as an example, of course, other lever or similar mechanisms can be used, which permit certain respective optimal curve forms along which the front ends of the depositing fingers are to move, simply and with the least constructional complexity.

The above statements reveal that the depositing fingers of the depositing device have the task not only of depositing the separate, folded tissues on the tissue stack, but also of holding them down or securely on the stack, in order to form exact tissue stacks 12 in this way, with the fold lines of the tissues being precisely superposed and parallel to one another, so that the subsequent packaging of parts of the tissue stack 12 in predetermined numbers of tissues in each case is substantially simplified. This makes it possible in particular to do without the otherwise necessary holding-down fingers present in addition to the depositing fingers.

The device embodied in accordance with the invention makes it possible to substantially increase efficiency, since the working speed of the depositors is reduced by increasing their numbers, so that no problems which tended to reduce productivity arise at this otherwise problematical place in the device.

What is claimed is:

1. An apparatus for the formation of stacks of folded, zig-zaggedly intermeshed tissues made from fibrous materials, with the tissues being individually intermeshed so that part of the tissue is covered by part of the immediately following tissue, said apparatus comprising mechanism for supplying two fibrous material webs, a cutting device associated with each of the two webs for transversely cutting of said webs into individual tissues in staggered relation to one another; a device for folding each of the separated staggered tissues along a transverse line across the tissue; a shaft receiving the intermeshed tissues in a stack; and a depositing mechanism for each device for folding the tissues, each including first and second drive mechanisms, associated with said shaft for depositing and holding down the respective uppermost tissue of the stack; said device for folding comprising a folder roll for each fibrous material web for folding the cut tissues from each web; each of said folder rolls (23) having associated therewith at least one comb-like depositor (27), as part of said associated depositing mechanism, being disposed on opposite sides of the stack shaft (13), each said at least one depositor comprising: a depositor beam (28) with a plurality of laterally guided depositing fingers (26) swung back and forth relative to the tissue stack (12) by connecting rods (30) and first drives (32, 33) in said first drive mechanism; and a second drive mechanism (35, 36, 37, 38, 39) interconnected with each said depositor to enable oscillating of said depositor correlated with swinging of said depositor back and forth; and drive means for each of the associated said first drive mechanism and said second drive mechanism inter-related with said cutting devices and the rotation of said folder rolls so that each of the associated said first and said second drive mechanisms respectively drive their associated said depositor in said swung back and forth movement and said vertically oscillated movement synchronously with the rotation of said folder rolls, whereby the front ends of the laterally reciprocating and vertically oscillating depositing fingers (26) grasp behind the respective tissue (22) to be deposited on the stack, press down against the tissue stack (12) and hold the same securely in the shaft (13) until a new cycle of movement begins.

2. An apparatus according to claim 1, wherein each folder roll has associated therewith a plurality of at least two of said depositors (27, 27') and their associated first and second drive mechanisms with at least the front ends of said depositing fingers (26, 26') of all of said depositors being parallel to one another and lying on the same plane, and wherein the first and second drive mechanisms therefor are designed so that each single depositor (27, 27') catches, presses down and holds fast a different tissue (22, 22') in a sequence of plurality tissues to be deposited equal in number to said plurality of said depositors.

3. An apparatus as defined in claim 1, wherein each depositor beam (28) is disposed normal to the path of said stacked tissues and has two ends; a different one of said connecting rods (30) is associated with each end of said depositor beam, with means pivotally linking one end of each connecting rod to the associated end of said depositor beam and a pair of rocking arms (31), associated with said first drive mechanism, each have one end pivotally connected (29) to said means pivotally linking a connecting rod to an end of a depositor beam to rockably support said depositor beam.

4. An apparatus according to claim 3, wherein the other ends of the connecting rods (30) are coupled to an associated said drive (32, 33).

5. An apparatus according to claim 3, wherein lever arms (35, 35') are fastened to both ends of the depositor beams (28, 28'), and linkage means couple the rear ends of said lever arms to said second drive mechanism (38, 39).

6. An apparatus according to claim 4, wherein said first and second drive mechanisms respectively comprise crank arm drives (32, 33 and 38, 39).

7. An apparatus according to claim 4, wherein said first and second drive mechanisms comprise drive levers.

* * * * *